United States Patent [19]

Hoeber

[11] Patent Number: 4,838,018

[45] Date of Patent: Jun. 13, 1989

[54] PROCESS AND DEVICE TO START A NEW STAPLE FIBER SLIVER AUTOMATICALLY

[76] Inventor: Werner G. Hoeber, Weckenweg 32, D-8070 Ingolstadt, Fed. Rep. of Germany

[21] Appl. No.: 211,238

[22] Filed: Jun. 24, 1988

[51] Int. Cl.[4] ..... D01H 7/882; D01H 15/02

[52] U.S. Cl. ..... 57/263; 19/157; 57/264; 57/409

[58] Field of Search ..... 57/261, 263, 264, 301, 57/302, 400, 405, 408, 409, 412; 19/97.5, 105, 0.25, 239, 240, 157, 159 R, 151

[56] References Cited

U.S. PATENT DOCUMENTS

| | | | |
|---|---|---|---|
| 2,608,725 | 9/1952 | Strew | 19/157 |
| 4,156,341 | 5/1979 | Raasch | 57/405 X |
| 4,195,388 | 4/1980 | Bulla | 19/157 |
| 4,224,719 | 9/1980 | Bulla | 19/157 |
| 4,653,263 | 3/1987 | Stahlecker et al. | 57/263 |
| 4,742,675 | 5/1988 | Leifeld | 19/105 X |

FOREIGN PATENT DOCUMENTS

| | | | |
|---|---|---|---|
| 2230644 | 12/1972 | Fed. Rep. of Germany | 19/157 |
| 2739 | 2/1966 | Japan | 19/157 |
| 135792 | 2/1960 | U.S.S.R. | 19/157 |

*Primary Examiner*—Joseph J. Hail, III

*Attorney, Agent, or Firm*—Dority & Manning

[57] ABSTRACT

For the starting of slivers at a textile machine, two staple fiber slivers are individually inserted into two guides. The first guide assumes a feeding position and guides the staple fiber sliver being fed into a feeding device. The second guide holds the second staple fiber sliver in a readiness position. When the first staple fiber sliver going to the feeding device is interrupted, the first, empty guide is brought from its feeding position into its readiness position. At the same time the second guide, together with the staple fiber sliver inserted into it, is brought into the feeding position. Thereupon, a new staple fiber sliver is introduced into the first guide, now in the readiness position, whereupon a new sliver is put in readiness. The two guides are connected to each other with respect to movement. The invention also includes the process for replacing an interrupted supply of sliver to reduce down time to a minimum.

13 Claims, 10 Drawing Sheets

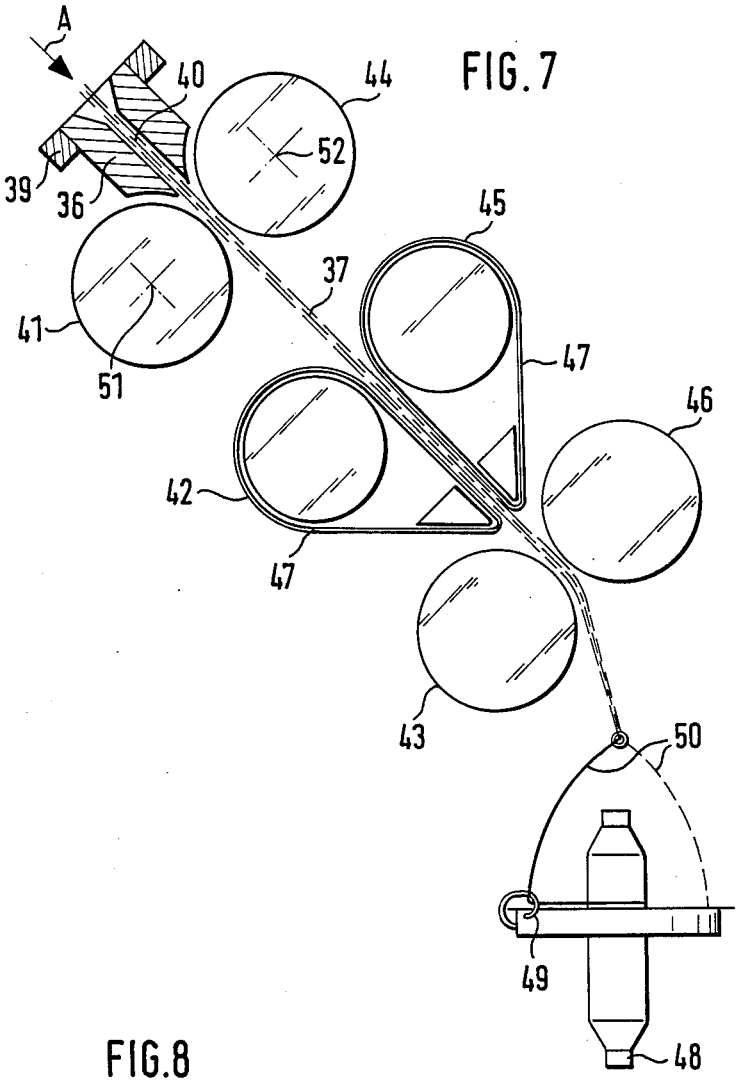
FIG. 7
FIG. 8
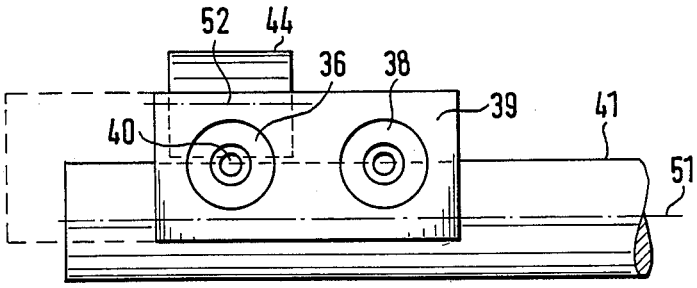

89
76
78
92
82
80
84
74
86
65
91
85
11
69
70
19
18
72
71
66
12
83
11
67
68
13
11
14
16
24
13'
91'
79
73
92'
77
81
87
75
88
90

PROCESS AND DEVICE TO START A NEW STAPLE FIBER SLIVER AUTOMATICALLY

BACKGROUND OF THE INVENTION

The instant invention relates to a process for the automatic starting of a staple fiber sliver at a textile machine with a feeding device, in which two staple fiber slivers are inserted into two guides. The first guide assumes a feeding position and guides the first staple fiber sliver, being fed, to the feeding device, while the second guide holds the second staple fiber sliver in a readiness position. The second staple fiber sliver is brought into the feeding position and is fed to the feeding device when the feeding of the first staple fiber sliver is interrupted. The invention also includes a device to carry out this process.

Known spinning machines of this type, have the disadvantage that when a fiber sliver or a fiber roving supplied by a bobbin or a can, is used up, the replacement by a new package, i.e. by a new can or a full bobbin, and the introduction of the sliver or roving into the spinning station is time consuming. The stoppages of the spinning station or of the entire spinning machine, thus caused, are very costly. It would be possible to eliminate stoppages to a certain degree by providing operating personnel that would be prepared at all times to carry out the replacement immediately as soon as a package has been signalled as having been used up. However, this would also lead to great labor costs.

A device is already known in which two guides for slivers are provided. The first guide is assigned to the staple fiber sliver being fed to the feeding device while the second guide is assigned to the staple fiber sliver which is in the readiness position (German Patent No. DE-PS 922.579). Both guides in this patent are stationary. When the staple fiber sliver being fed to the feeding device has been used up, the forward end of the second staple fiber sliver, held in the readiness position, is released and, thus, reaches the position which was previously assumed by the used-up staple fiber sliver. To be able, later, to replace this second staple fiber sliver, which reaches the feeding device through the second guide with a new staple fiber sliver, it is necessary to take the second staple fiber sliver out of the second guide and to insert it into the first guide so that the new replacement sliver can be inserted into the first guide. This switch-over of the staple fiber sliver requires additional time and can also interfere with the work process.

SUMMARY OF THE INVENTION

These disadvantages are eliminated through the instant invention. It is the object of the instant invention to provide a process and a device which makes it possible to start a staple fiber sliver in a time-saving manner.

This object is attained by the invention, in that when the supply of the first staple fiber sliver to the feeding device is interrupted, the first, empty guide, is brought from the feeding position into a readiness position, and, in that, the second guide, together with the second staple fiber sliver inserted into it, is simultaneously brought into the feeding position, whereupon the new staple fiber sliver is inserted into the first guide, now in a readiness position. The two guides are of equal rank, and alternately, carry out the task of feeding a staple fiber sliver to the feeding device or of holding a staple fiber sliver in the readiness position. These tasks are exchanged through a change in the location of the two guides. Since no guide serves only for feeding or only for readying a staple fiber sliver, this process of automatic sliver starting can be repeated, automatically, as many times as desired.

In a process which has proven particularly advantageous, the readiness position into which an empty guide is brought for the insertion of a new staple fiber sliver is provided, alternately, on one or the other side of the feeding position. This makes it possible to use simple devices with linear movement that can also be used when only limited space is available.

An especially simple embodiment of the device is made possible if provision is made for the guides to be moved parallel to the axis of the supply roller in a particularly advantageous embodiment of the device according to invention.

To ensure that a new staple fiber sliver can be brought rapidly into the readiness position when a staple fiber sliver has been used up, it is advantageous for the guide, which is in the readiness position, to be monitored for the presence of a staple fiber sliver, and for a signal to be triggered in the absence of a staple fiber sliver, so that a new staple fiber sliver can be readied in time. It is advantageous, for this purpose, to provide for the insertion of a new staple fiber sliver into an empty guide to be triggered by this signal.

Due to accidental contact with the staple fiber sliver in the readiness position, the sliver may partially or completely slide out of the guide, so that, later, an automatic feeding of the staple fiber sliver to the feeding device is not possible. To avoid this, the staple fiber sliver is preferably secured in its inserted position after completion of the inserting process.

The process, according to the invention, can be carried out in a particularly practical and spacesaving manner if a common feed of a third staple fiber sliver is provided for two adjoining feeding devices. These feeding devices are alternately supplied with a new staple fiber sliver with such timing that, when one feeding device receives a new staple fiber sliver, approximately one half of the staple fiber sliver of the other feeding device has already been fed into said feeding device. The staple fiber sliver, which is running out, is replaced by a new one and is associated to the feeding device where the staple fiber sliver supplied will next run out. In this way, one single reserve sliver suffices for two feeding devices.

When the feeding of a staple fiber sliver to a feeding device is interrupted, the switch-over of the guides is effected, preferably, early enough so that the beginning segment of the new staple fiber sliver can come to lie on the end of the staple fiber sliver running out and can enter the feeding device together with it. In this way an interruption of the work process is avoided. The beginning segment of the new staple fiber sliver is, preferably, not merely laid on the end of the staple fiber sliver being used up, but this end is combined with the beginning segment of the new staple fiber sliver before the latter is introduced into the feeding device. In this manner continuity of the work process is achieved more reliably than if the two staple fiber slivers are simply laid one on top of the other.

If the staple fiber sliver is started up at an open-end spinning device, the start-up of the new staple fiber sliver is preferably carried out, only after a yarn breakage has occurred, whereupon the overlapping of the fiber slivers is fed to the open-end spinning device after the start-up of the new staple fiber sliver is completed and is then again removed from it and is again attached by piecing. The overlap of the fiber slivers which, unavoidably, leads to irregularity in the further process is thus removed, so that the spun yarn consists only of segments of fiber slivers which have the desired cross-section.

To carry out the process, the two guides, according to the invention, are connected to each other with respect to their movement in such a manner that when one guide is moved from a feeding position into a readiness position, the other guide is moved from a readiness position into a feeding position. Each guide thus contains, alternately, the staple fiber sliver which is in feeding position or that which is in the readiness position. This allows for a simple and rapid sliver start-up. The two guides are preferably not only connected to each other for control, but in a non-positive manner, since this ensures simultaneous switch-over adjustment of the two guides by simple, mechanical means.

A readiness position is preferably provided on either side of the feeding position. One guide can be moved alternately into one readiness position or into the feeding position, while the other guide can be brought alternately into the feeding position or into the other readiness position. Simple construction is achieved if the guides can be moved parallel to the axis of a feeding roller.

In an advantageous embodiment of the instant invention, the two guides are attached to a common pivoted piece capable of bein pivoted around an axis and brought, alternately, into a feeding position or into a readiness position by the pivoting motion of the piece around the axis. The feeding and readiness positions are, preferably, diametrically opposed to each other in relation to the axis, so that the two guides can be moved back and forth between their feeding and their readiness position by a pivoting movement by 180°.

To achieve reliable feeding of the newly started staple fiber sliver to the feeding device, provision is made for the output point of the guide, which is in feeding position, to be located directly in front of the converging space before a feeding roller and, for the distance between this guide and the feeding roller, to be adjustable by the movement of the pivoted piece. The pivoted piece is preferably capable of being retracted or of being pushed forward in a direction parallel to the axis. It has proven advantageous for the pivoted piece to be tilted around an axis which is perpendicular to the abovementioned axis.

In an advantageous embodiment of the device, according to the invention, the guides are fixedly, connected to a feeding plate, interacting with the feeding roller, and are capable of being moved together with, the feeding plate into the feeding and readiness positions. Alternatively, provisions can be made for a stationary feeding plate, interacting with the feeding roller, and prestressed towards the feeding roller by an elastic means. In this case, the feeding plate is, preferably, equipped with guide ramps which serve to guide the beginning sections of the fiber slivers hanging out of the guides when the guides are being switched from the ready position to the feeding position. These ramps are preferably arched downward and away from the nip with the feeding roller.

In a further advantageous embodiment of the device according to the invention, the output of the guide, which is in the feeding position, is located directly in front of the converging space before the inlet cylinder and a pivoted pressure roller, prestressed against the latter, of a feeding device which constitutes part of a drawing roller unit.

In order to be able to prepare quickly a new staple fiber sliver as a replacement for a broken or used-up staple fiber sliver, it is advantageous if a monitoring unit is provided to monitor the guide, which is in the readiness position, for the presence of a staple fiber sliver, and to trigger a signal in case of the absence of a staple fiber sliver. If a service unit, capable of travelling alongside several sliver feeding positions, is provided, the monitoring device is, preferably, connected to a call-up device for the service unit which can be equipped with a switch-over device for the two guides. To make it possible for a new sliver to be inserted economically into the guide which is in its readiness position, the service unit is preferably equipped with a sliver starting device.

It is especially advantageous, in order to effect a good connection between the old and the new staple fiber sliver when a new sliver is started, for the guides to interact with a known apparatus for the automatic connecting of a staple fiber sliver, e.g. by twisting or splicing.

In an advantageous embodiment of the object of the invention, the textile machine is made in form of a draw frame with several sliver feeding positions, whereby a first and a second guide is provided, together per each sliver feeding position, in front of the feeding device assigned to several sliver feeding positions. The guides are capable of being brought alternately into a feeding or readiness position. In this way, a new sliver can be started at any time at each sliver feeding position, independently of the other sliver feeding positions. The operator has all the time necessary to insert a new staple fiber sliver into the empty guides which are in the readiness positions.

In another advantageous embodiment of the device according to the invention, the textile machine is made in the form of an open-end spinning machine, and is provided with a plurality of adjoining spinning stations, each with its own feeding device, whereby a first and a second guide is provided in front of each feeding device, the guides being capable of being moved alternately into a feeding or a readiness position.

Although the invention is especially advantageous with a drawing frame and with an open-end spinning machine, it can, however, also be used to advantage with other textile machines which process a staple fiber sliver.

"Staple fiber sliver", in the sense of the instant invention, is to be taken to mean not only a non-twisted fiber sliver, but also a sliver with a slight twist such as a roving, or the like.

The invention makes it possible to automatically introduce a reserve sliver into the spinning, processing or treatment process when the sliver being fed is used up in the textile machine, without a significant loss of time, so that the textile machine can continue to operate without significant loss of time, i.e. immediately after the insertion of the reserve sliver by the automatic device or control provided for that purpose. In terms of length of time, this lost time is about equal to the time required for the automatic repair of a yarn breakage in the known spinning machines. The time from exhaustion of the reserve sliver introduced into production or of the reserve package, i.e. a long period of time, is then available for the subsequent manual or mechanical replacement of the empty package. This is especially valuable with automatic machines because only few operators are then required. This method of operation makes it possible, for instance, to work in long night shifts with little operating personnel, where the operating personnel only has to carry out supervisory functions, i.e. do not intervene directly in the work process.

The instant invention finds its applications mainly for spinning with ring spinning machines, using rotor and friction process and air nozzle spinning, but can also be used with other textile machines, e.g. drawing frames.

BRIEF DESCRIPTION OF THE DRAWINGS

The invention is explained in greater detail below with the help of the drawings in which:

FIG. 7 is a schematic illustration of another embodiment of the invention, with a drawing roller unit of a ring spinning machine;

FIG. 8 is a front view of the guides shown in FIG. 7, seen in direction of arrow A of FIG. 7;

DETAILED DESCRIPTION OF THE DRAWINGS

Figure 2:
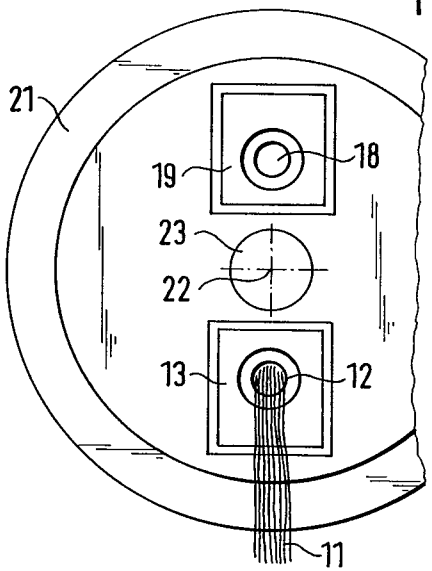
FIG. 2 is a side view of the device of FIG. 1.
Figure 1:
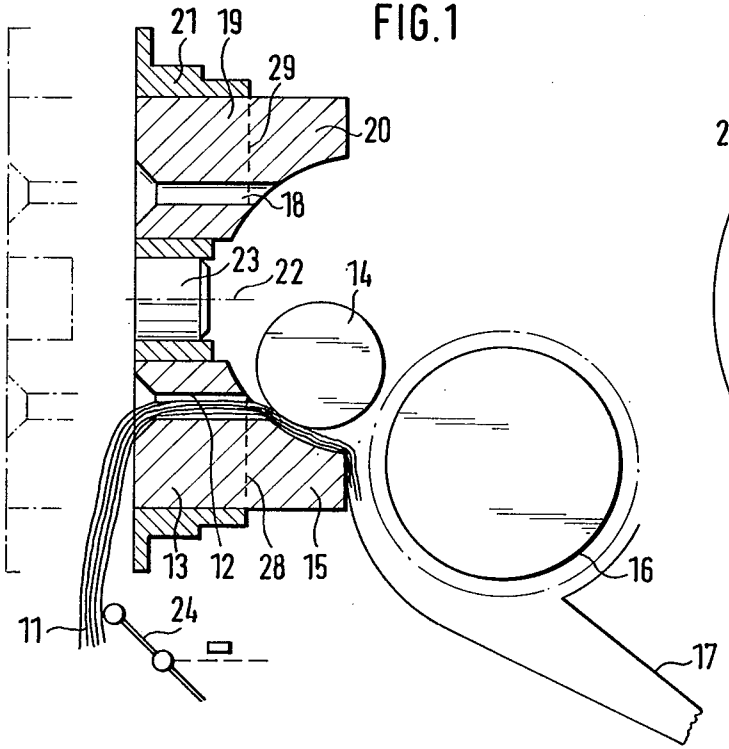
FIG. 1 is a cross-sectional view of a first embodiment of a spinning device, according to the invention.

Referring to FIGS. 1 and 2, a staple fiber sliver 11 is guided in a guide 13 through a channel 12. The output of channel 12 is located in direct proximity of a feeding roller 14, i.e. directly before the converging space of this feeding roller. The feeding roller, together with a feeding plate 15, serves to convey the staple fiber sliver 11 to an opening cylinder 16, constituting a drawing element. A fiber feeding channel 17 serves to convey the fibers opened by means of cylinder 16, to a twist-imparting element (not shown) or to a spinning rotor. In this embodiment, the guide 13 and the feeding plate 15 constitute one building unit.

In addition, a second guide 19 with a second channel 18 and a second feeding plate 20 are provided. An additional staple fiber sliver (not shown) is held in channel 18. Guide 19 and feeding plate 20, together with guide 13 and feeding plate 15, are held by a ring-shaped body 21 and are carried by a shaft 23 capable of being pivoted around axis 22. In FIGS. 1 and 2, guide 13 is shown in the feeding position and guide 19 in a readiness position. These designations shall be further defined later in the course of the description. Guides 13 and 19, together with the feeding plates 15 and 20, are connected to shaft 23 which is capable of executing a 180° pivoting movement. Each of the guides 13, 19, is thereby, alternately, brought into the feeding or the readiness position. The staple fiber sliver 11 is taken from a production package (not shown), or from a production can, and is pulled through guide 13 into the feeding position. Furthermore, a second staple fiber sliver (not shown), delivered by a reserve can (not shown), which serves as a reserve package, is led through channel 18 and is held in the latter channel.

To monitor the staple fiber sliver 11, i.e. to ascertain its presence or to produce a signal if necessary, in case of its absence, a monitoring device 24 is used.

Guides 13, 19, together with the feeding plates 15, 20 are, furthermore, capable of being displaced in a direction parallel to axis 22, to the left, as seen in FIG. 1, by means not shown here, and are thus, retractable into the position indicated by dots and dashes in FIG. 1, and are also capable of being advanced back into the starting position represented by full lines in FIG. 1.

In operation, the staple fiber sliver taken from the production package, and fed through guide 13 to the opening cylinder 16, acting as a drawing device, is constantly conveyed between the feeding roller 14 and the feeding plate 15. In the work phase shown in FIG. 1, guide 13 is in the feeding position. If enough of the staple fiber sliver of the production package has been consumed, the monitoring device 24 produces a signal which in a first step causes the guides 13, 19 together with the feeding plate 15, 20 to be pulled back in a direction parallel to axis 22 (to the left, in FIG. 1). Shaft 23 is then pivoted by 180° in a second step. Finally, in a third step, the guides 13, 19, together with the feeding plates 15, 20 are pushed forward once more, parallel to axis 22 (to the right, in FIG. 1), so that their positions are now mutually interchanged, by comparison to their starting positions.

Guide 13 is now in the readiness position and guide 19 in the feeding position. In the event that the production package or can is empty, the staple fiber sliver held in channel 18 is automatically brought between feeding roller 14 and feeding plate 20, and fed to the opening cylinder 16. It is taken out of the package which had previously been the reserve can and, which now constitutes the production can, following the exchange of guides 13, 19. The exchange process requires a minimum of time, analogous to the time required for the automatic repair of a yarn breakage. When practical, the empty can is replaced by a full can and the beginning end of the sliver of this full can is guided through channel 12, to be held therein. This full, or second can now constitutes the reserve can. Much time (around several hours) is available for the replacement of the empty can by a new one. When the second can also becomes empty in the course of operation, the described process is repeated once more. Guides 13, 19 together with feeding plates 15, 20 are then returned to the positions shown in FIG. 1.

Figure 3:
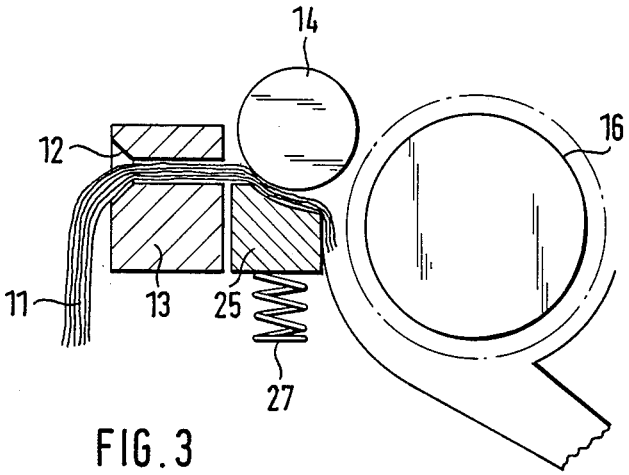
FIG. 3 is a cross-sectional view of another embodiment of the invention, taken along line III—III of FIG. 4.
Figure 4:
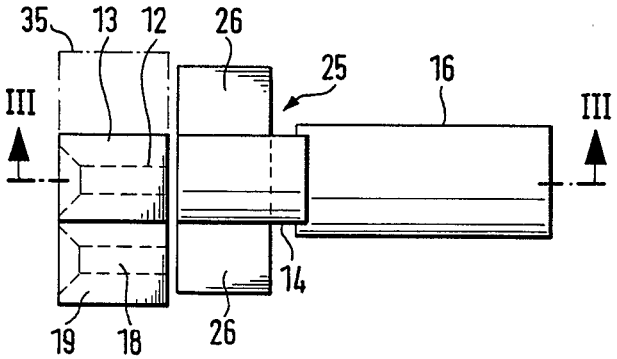
FIG. 4 shows a top view of the embodiment illustrated in FIG. 3.

Referring to FIGS. 3 and 4, two guides 13, 19 are again provided, together with channels 12, 18. They are made in one single piece and can be moved parallel to the axis of the feeding roller 14, and to the lateral surfaces of a feeding plate 25. The guide 13 is located in the feeding position and the guide 19 in the readiness position. The staple fiber sliver of a production package is fed to guide 13, and the staple fiber sliver of a reserve package is fed to a guide 19. Guides 13 and 19 are located directly, and with a minimum interval between them, at the lateral surface of feeding plate 25. The latter is equipped with two guide ramps 26 which, preferably, arch downward towards their free ends so as to afford guidance for fiber sliver ends hanging out of channels 12, 18, at the output side.

Above the feeding plate 25 is a feeding roller 14 which, together with feeding plate 25 serves to convey a staple fiber sliver 11 (not shown in FIG. 4) through channel 12, and to an opening cylinder 16. A resilient device, e.g. a spring 27, prestresses the feeding plate 25 in the direction of the feeding roller 14. As in the embodiment of FIGS. 1 and 2, FIGS. 3 and 4 also show an embodiment of the staple fiber sliver being opened by opening cylinder 16 into fibers which are conveyed into a spinning rotor (not shown).

As soon as the staple fiber sliver taken from the production package has been used up in the operation, i.e. when an appropriate monitoring device indicates its absence, guides 13, 19, which are interconnected in their movement, are moved in such manner that guide 19 goes into feeding position and guide 13 into the position 35 indicated by a broken line which is the readiness position for guide 13. Thereby, the staple fiber sliver held by channel 18 and supplied by the reserve (second) can is seized, for example, by means of a conveying device (not shown) within the guide, and the spinning process continues after a brief interruption. The original production package, which is now empty, must then be replaced by a new one, and the fiber sliver of this new package must be introduced into channel 12 and held therein. To carry out the last two steps mentioned, sufficient time, for all practical purposes, is again available.

Once the fiber sliver taken from the original reserve can has been used up, the guides 13 and 19 are brought back into their original position as shown in the FIG. 4. When the second empty can has been replaced by a full one the starting end of the fiber sliver to be taken from the latter must be introduced into channel 18 and must be held by it.

As shown in FIGS. 3 and 4, a readiness position is provided on either side of the feeding position, and this readiness position is assumed alternately by one or the other of the guides 13 and 19. This provides for very simple movements of guides 13 and 19, especially linear movements, in particular, parallel to the axis of feeding roller 14, thus avoiding retraction and forward movements transversely to that axis. By comparison with the embodiment of FIGS. 1 and 2, it can be seen that in the embodiment of FIGS. 3 and 4 only a longitudinal movement of the guides 13, 19 is necessary for sliver replacement, while a retraction and pivoting motion and a forward motion of guides 13 and 19 and of the feeding plates 15, 20 take place in the embodiment described in FIGS. 1 and 2.

It is possible to eliminate the retraction into the position shown by dots and dashes and the subsequent forward movement, by modifying the embodiment shown in FIGS. 1 and 2. This is the case in an embodiment in which the feeding plate 15 is prestressed separately and by a resilient means (not shown) along the plane of guide 13, perpendicular to the plane of the drawing and defined by straight line 28, in direction of the feeding roller 14 and in which the feeding plate 20 is also separated from guide 19 along the plane perpendicular to the plane of the drawing and defined by the straight line 29. Under these conditions the introduction of a new fiber sliver only requires a pivoting of guides 13 and 19 by 180°, the retraction and forward movements being no longer necessary.

It can be seen that the embodiment in FIGS. 1 and 2, with the retraction and forward movement of guides 13 and 19 with the feeding plates 15 and 20 has the advantage that no gap or interval in which fibers can become caught exists between guides 13 and 19, on the one hand and the feeding plates 15 or 20, on the other hand. In this embodiment the guidance effected by channels 12 and 18 to the nip of the feeding roller 14 and the feeding plate 15 or 20 is shorter than in the embodiment with the separate, non-pivoted feeding plate 15 or 20.

Furthermore, the embodiment according to FIGS. 3 and 4 and the embodiment according to FIGS. 1 and 2, characterized by the omission of the feeding plate 20 and by a feeding plate 15, which is not capable of being pivoted have the advantage that the respective setting of feeding plate 15 or 25, in relation to feeding roller 14 is always constant. The operations for the feeding of the sliver to the opening cylinder 16 thus remain constant, whichever of the guides 13 and 19 is in feeding position. This ensures constant yarn quality. Added to this, is the already mentioned fact that the retraction movement shown by dots and dashes in FIG. 1 is not needed. This means shortening of the time required for sliver replacement and a simpler design of the spinning aggregate. Depending on existing conditions, one or the other embodiment will receive preference.

Figure 5:
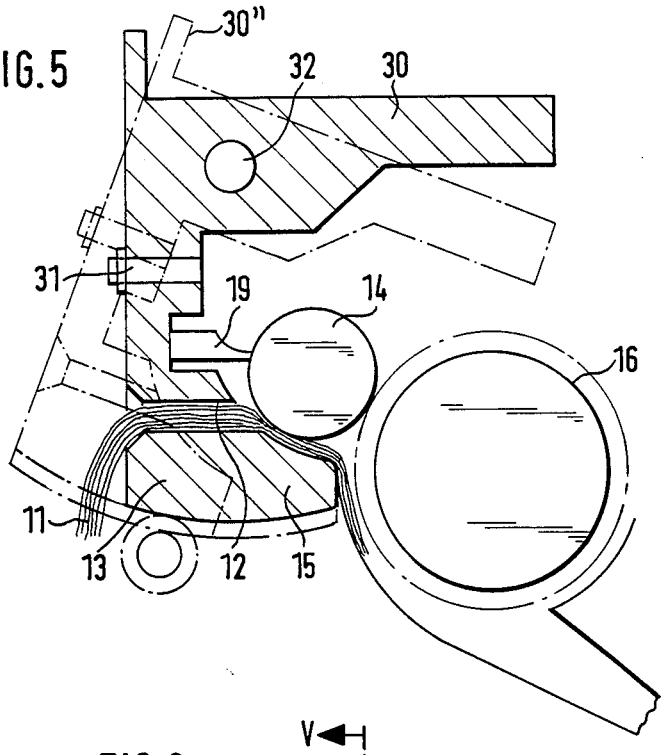
FIG. 5 is a cross-sectional view of yet another embodiment of the invention, taken along line V—V of FIG. 6.

The embodiment of FIGS. 5 and 6 again shows two guides 13 and 19, equipped with channels 12 or 18. Of these, guide 13 is in the feeding position and guide 19 in the readiness position. For the sake of clarity, only FIG. 5 shows the staple fiber sliver 11 of the two staple fiber slivers which are, again, taken from a production package and from a reserve package (not shown) and introduced into the channels 12 or 18. Guide 13, which is in the feeding position, together with feeding plate 15, again form one single structural unit. Guide 19 and a feeding plate, which is not visible in FIG. 5, also form one single structural unit. Feeding plate 15, which is in the feeding position, interacts with a feeding roller 14 to feed the fiber sliver during the operation to the opening cylinder 16 (not shown in FIG. 6). Guides 13 and 19 are installed on a pivoting piece 30.

Figure 6:
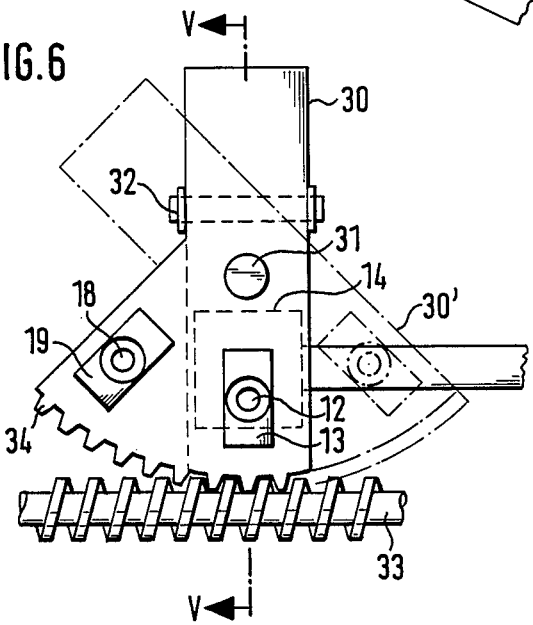
FIG. 6 is a front view of the device shown in FIG. 5.

This pivoting piece 30 can be pivoted around a shaft 31 into a position 30', indicated by dots and dashes in FIG. 6, so that the guides 13 and 19 can be brought selectively into their readiness or feeding positions. Pivoting piece 30 can also be tilted, together with shaft 31, around the axis of an additional shaft 32 into position 30'', indicated by dots and dashes in FIG. 5. The pivoting movement around axis 31 in the shown exemplary embodiment is carried out by means of a threaded spindle, i.e. a rotating screw 33 and a worm wheel 34 driven by same.

In the operation of the embodiment of FIGS. 5 and 6, the fiber sliver is constantly fed through the feeding roller 14 between the latter and the feeding plate 15 and to opening cylinder 16. When this sliver, taken from a production can (not shown in the drawing) is used up, a signal causes a tilting of pivoting piece 30 around the axis of shaft 32 into its position 30'' as shown in FIG. 5. Pivoting body 30 then pivots into its position 30', indicated by dots and dashes in FIG. 6, under the impulse of the driven screw 33. This brings guide 19, in whose channel 18 the start of the fiber sliver from a reserve package has already been introduced, from its readiness position into its feeding position. Following this, pivoting body 30 is again tilted back around the axle of shaft 32 into its original position so that the feeding plate belonging to guide 19 is brought into interaction with feeding roller 14. In this movement, guide 13 is moved into its readiness position, represented by dots and dashes in FIG. 6. This starts a new staple fiber sliver at the feeding roller 14.

The replacement process described requires only little time, so that the spinning process continues after a very short interruption. To replace the original production can, which is now empty, sufficient time is now available for all practical purposes.

When the fiber sliver of the original reserve can has been used up, a pivoting-away movement around the axis of shaft 32, a pivoting movement around shaft 31, into the starting position indicated by solid lines in FIG. 6 and a tilting-back movement around shaft 32 occur, with guide 13, again, reaching its feeding position to supply the feeding roller 14.

Similarly, as was explained through FIGS. 1 and 2, it is also possible in this embodiment to install the feeding plate 15 separately from pivoting body 30 and in constant contact with, and directly next to the feeding roller 14. In this case the tilting movements around the axis of shaft 32 are not needed.

Guides 13 and 19 are always linked together in their movement so that when one of the guides moves from a readiness position into its feeding position, the other guide is moved into the same, or into another readiness position. For this purpose a non-positive connection can be provided between the guides, and these could possible also be integrated into one single structural unit, but it would be enough if such a synchronous movement is attained through appropriate control of separate drives only where the guides are independent of each other.

Up to now, the application of the invention to open-end spinning has been explained. It will now become apparent that the application of the invention in ring spinning apparatus yields similar advantages to those obtained in open-end spinning apparatus.

In a ring spinning arrangement, as seen in FIGS. 7 and 8 a guide 36 is provided for a fiber supply which is only shown in FIG. 7, consisting of a staple fiber sliver or a roving 37. Guide 36 is in its feeding position. A second guide 38 is in its readiness position. The guides 36 and 38 are supported on a supporting plate 39. Each one of them is provided with a channel 40 through which a sliver is drawn. Furthermore, drive rollers 41, 42, 43 and the prestressed pressure rollers 44, 45, 46, pressing against them are provided. Rollers 41 and 44 are able to rotate around their axes 51 and 52, shown in FIG. 8. Rollers 42 and 45 serve to drive the belts 47 of a double-belt drawing roller unit. In the drawing roller unit shown, the pre-drawing zone is located between the rollers 41, 44 and 42, 45 and the main drawing zone between the rollers 42, 45 and 43, 46.

The rotation of a bobbin 48, which operates as a twist-imparting element with traveler 49 and causes the twisting of the fiber material coming out of rollers 43, 46, i.e. the production of a yarn as well as the rotation of a traveler 49 on a ring around bobbin 48 and, thus, the winding up of the yarn on bobbin 48 with a balloon 50 being formed. The support plate 39, together with the guides 36, 38 is capable of being shifted parallel to the axes 51 and 52, with either guide 36 or guide 38 going through pressure roller 44 into feeding position.

In the operation of the spinning apparatus shown in FIGS. 7 and 8, feed material, consisting of a fiber roving drawn out of a package constituted by a bobbin (not shown), is drawn in the drawing roller unit 41 to 47 and the spun yarn is wound up on bobbin 48. In order to keep production stoppage caused by a bobbin becoming empty as short as possible in this spinning process, the same procedures are followed as in the embodiments mentioned earlier.

Two roving bobbins are assigned to one spinning apparatus, whereby the roving of the supply bobbin is introduced into the guide 36 in the feeding position and the roving of the reserve bobbin is introduced into the guide 38 in the readiness position. As soon as the supply bobbin has been used up, similarly to the embodiment of FIGS. 3 and 4, guide 36 is brought into the readiness position (indicated by dots and dashes in FIG. 8), through appropriate control effected by a signal from a monitoring device, and simultaneously, guide 38 is moved into the feeding position, so that the spinning operation is resumed automatically. If the two guides continue to interact with an additional apparatus (not shown) for the automatic connection of the rovings, e.g. through twisting or splicing, it may be useful to continue the spinning operation without any interruption, on condition, however, that the connecting operation is carried out with sufficient care so that no yarn breakage nor any unacceptable thick spot or thin spot is produced in the yarn. To achieve this, the shifting of the guides must occur early enough so that the beginning of the new staple fiber sliver can come to lie on the end of the ending staple fiber sliver and enter the feeding device together with it. A long time segment is then available to replace the tube of the original feeding bobbin with a full bobbin.

The space provided in spinning machines for the supply packages (cans, bobbins) is often limited. The placement of reserve supply packages can, therefore, prove difficult.

Figure 9A:
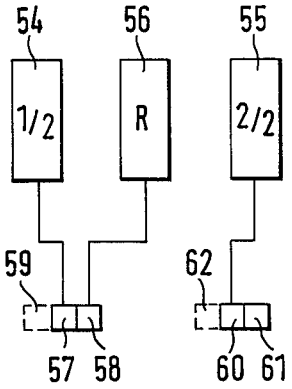
FIGS. 9(*a*), 9(*b*), and 9(*c*) illustrate, schematically, different work phases of another embodiment of the device, according to the invention.

An arrangement requiring little space is obtained in an embodiment according to the instant invention, in which one single reserve feed is provided for either of two adjoining spinning apparatuses. To explain the operations of this embodiment, reference is made to FIG. 9. A bobbin 54 is assigned to the first of two adjoining spinning apparatuses and a second bobbin 55 assigned to the spinning apparatus adjoining it. In addition, a third bobbin 56, constituting a reserve or standby supply bobbin is provided. The roving of bobbin 54 is guided to a guide 57 and the roving of bobbin 56 to a guide 58. Guide 57 is in the feeding position and guide 58 in its readiness position. Guide 57 can be brought into a readiness position 59.

The second spinning apparatus comprises guides 60 and 61, of which guide 60 is in the feeding position and guide 61 is in its readiness position. Guide 60 can be brought into a readiness position 62. The rove of bobbin 55 is brought to guide 60. In the operational phase according to FIG. 9*a*, no rove is brought to guide 61.

In the operation of this embodiment, bobbin 54 is half used up at the beginning of the spinning process. This is indicated by the indication "½". Bobbin 55, as indicated by the indication "2/2" is fully wound with roving. Bobbin 54, which is in its readiness position with the ready roving is fully wound and serves as a reserve bobbin, as is indicated by "R".

During the spinning process the roving slivers are drawn off from the bobbins 54 and 55, which are in the operating position. When one half the amount of roving representing a full bobbin is used up in the bobbins 54 and 55, bobbin 54 is empty. This automatically causes the first spinning apparatus, which comprises guides 57 and 58, to be switched off and guide 57 to be moved into its readiness position 59 and guide 58 to be moved into the feeding position. Upon resumption of the spinning process, roving is taken from the bobbins 56 and 55. The empty bobbin 54 is replaced by a full bobbin 63 which now assumes the function of a standby package or reserve bobbin. In addition, the roving of bobbin 63, which is now put into the feeding operation must be brought to guide 61. When this is accomplished, the conditions shown in FIG. 9*b* exist.

Figure 9B:
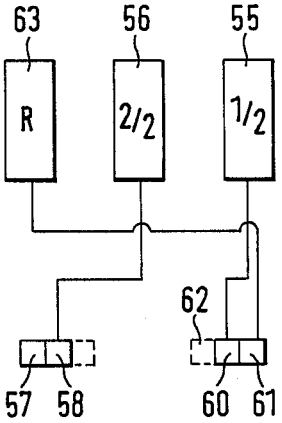
Figure 9C:
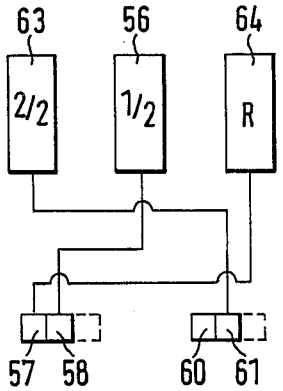

In the course of subsequent spinning operation, supply bobbin 55 is used up, whereupon the second spinning apparatus, comprising guides 60 and 61, is switched off and the guides 60, 61 are activated. This causes guide 61 to be brought into the feeding position and guide 60 into the readiness position, as shown in FIG. 9*b* at 62. When the spinning process has subsequently been resumed, bobbin 55, which is now empty, must be replaced by a full bobbin 64, which now constitutes the reserve package, and its roving must be brought to guide 57. This results in the situation as shown in FIG. 9*c*.

It is obvious that in the process, described above, a common, third sliver supply is provided for the feeding devices of two adjoining work stations. The two feeding devices are alternately supplied with new staple fiber slivers with such timing that when one of the feeding devices receives a new staple fiber sliver, the staple fiber sliver of the other feeding device has been used up by approximately one half. When the used up sliver has been replaced by a new sliver supply, this new sliver supply is assigned to the feeding device where the staple fiber sliver will be used up next. The above description, shows that the new package or reserve bobbin at each replacement is connected so as to be available to that pair of guides to which a production package, which is loaded with one half of the supply of a full production package, is connected.

The replacement of the packages, as shown in FIG. 9, may be effected for a ring-spinning machine for instance, with rovings wound up into bobbins. It should be noted, in this context, that if cans filled with fiber slivers are used, the same procedure can be followed, with the packages consisting of cans (full, half-full or empty) instead of bobbins.

In a spinning machine, functioning according to FIGS. 1 to 6, much time is available for the replacement of an empty package by a full package, so that even during half that period, as is the case for FIG. 9 for instance, enough time is still available, so that this embodiment is still an advantageous one. This is true because a long period of time is available when cans are used because of their size, and because of the comparatively slower ring spinning process the time available is longer. Therefore, the instant invention, as shown in FIG. 9, has the further advantage of reduced space requirement for supply packages.

As mentioned earlier, the instant invention is used, in particular, to put into operation a new supply automatically when the supply in operation has been used up. However, it is also of great advantage in case of breakage of the supply in operation. When this occurs, the device, according to the instant invention, transfers the guide which is in the readiness position to its feeding position, in the manner described, whereupon the spinning process continues, after a brief interruption.

As the above description shows, the invention can be modified in many ways, e.g. by replacing features by equivalents or other combinations of features.

Figure 10:
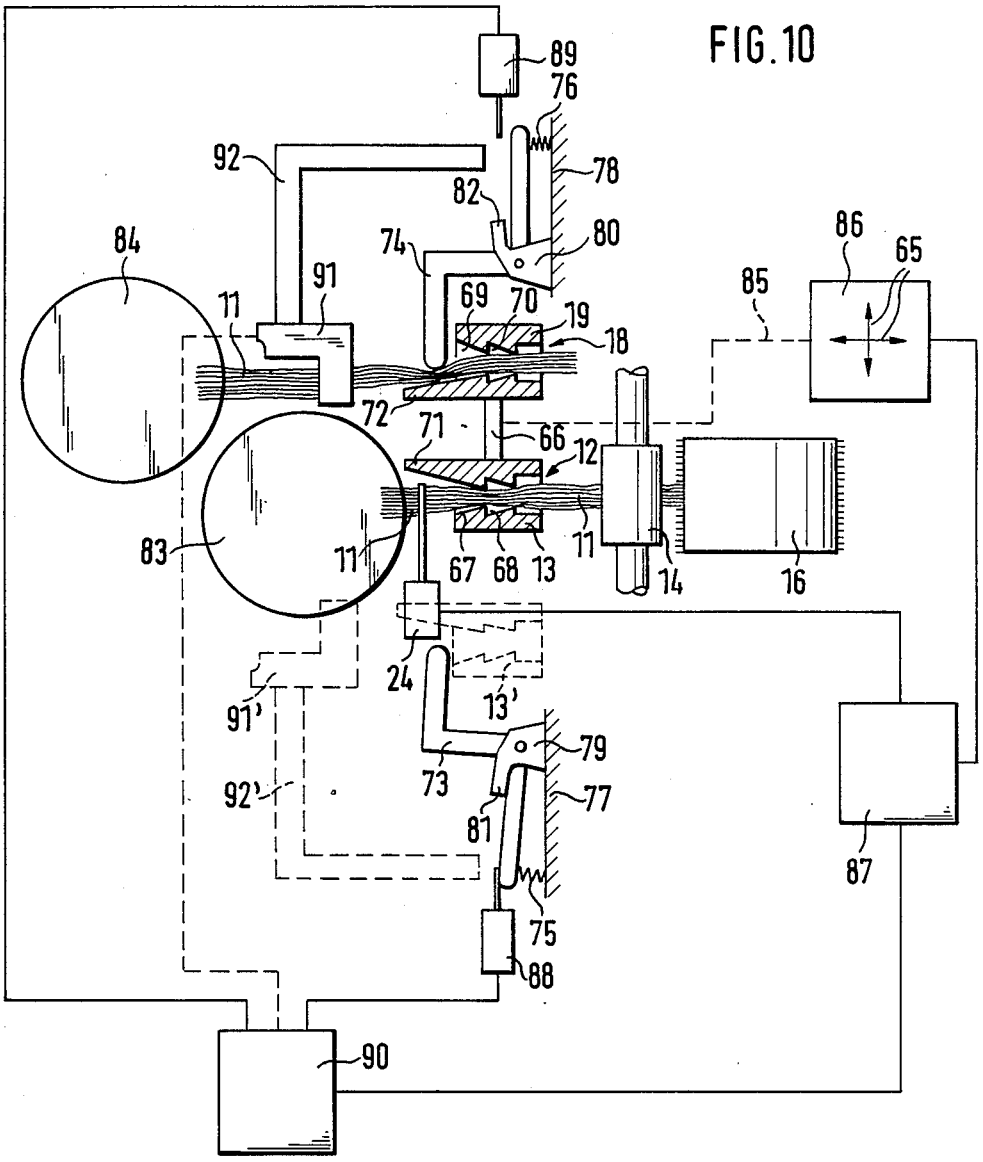
FIG. 10 illustrates, schematically, yet another embodiment of the device according to the invention, together with the control devices and connections required for control.

FIG. 10 shows a further embodiment of the device of FIGS. 3 and 4. For the sake of clarity, the distance between guide 13 and feeding roller 14 has been exaggerated. This distance can be kept shorter in principle, especially if guide 13 also supports feeding plate 15, as is shown in FIGS. 1 and 2. Furthermore, the distance between guides 13 or 15 and feeding roller 14 can be made variable so that guides 13 and 14 are not only capable of being displaced parallel to but also perpendicularly to, the axis of feeding roller 14. This is indicated in FIG. 10 by the double arrows 65 crossing each other.

As FIG. 10 shows, the two guides 13 and 19 are connected, non-positively, to each other by a connecting piece 66. A drive 86 is connected to this connecting piece 66 through a drive 85 indicated only by a broken line, drive 86 being capable of travelling in all of the four directions shown by the double arrows 65. In this way, the guides 13 and 15 can be moved from feeding roller 14 before their parallel shift towards it, and can then be shifted parallel to the axis of the feeding roller 14 and then brought close to said feeding roller 14.

In the embodiment shown in FIG. 10, the channels 12 and 18 are provided with several conically tapering longitudinal sections 67 and 68 or 69 and 70 in the feeding direction, making it more difficult for the fiber sliver 11 to slide back, without hindering the introduction of fiber sliver 11.

As seen in FIG. 10, each guide 13 and 19 is provided with an extension 71 or 72, extending in the direction of the sliver introduction side, with which one end of a bent lever 73 or 74 on a stationary support interacts. The other end of the bent lever 73 or 74 is subjected to the force of an resilient element, e.g. a pressure spring 75 or 76 bearing in an appropriate manner against a stationary support 77 or 78. The bracket 79 or 80 for the bent lever 73 or 74 is installed on this support 77 or 78. This bracket 79 or 80 is provided with a stop 81 or 82, which interacts with the end of bent lever 73 or 74 on the side of the pressure spring 75 or 76 in order to limit its maximum pivoting path caused by the pressure spring 75 or 76.

The bent lever 73 or 74 interacts with the extension 71 or 72 of guide 13 or 19 in the manner of a clamp in order to secure the fiber sliver 11 in guide 13 or 19 against unwanted slipping out or pulling out. Bent levers 73 and 74 are assigned to the guides 13 and 19 in such an arrangement that they secure the staple fiber sliver in the readiness position while releasing the staple fiber sliver 11 in the feeding position. Thus, the staple fiber sliver 11, fed to the feeding roller 14 from a can 83, is released while the staple fiber sliver coming from a can 84, and inserted into the guide 19, is clamped by the bent lever 74 against 72, and is thus secured. If the staple fiber sliver 11, drawn from can 83, is used up, this is detected by the monitoring device 24. The monitoring device 24 produces a signal in a control device 87 which, through appropriate control of drive 86 (see double arrow 65), brings guide 13 into its readiness position, indicated by a broken lines in which the bent lever 73 is pressed against the extension 71 of guide 13. Guide 19 moves from its readiness position into its feeding position, which is selected so that the staple fiber sliver 11, taken from can 84, is fed into the draw-in area of feeding roller 14, and is fed to the opening cylinder 16.

Each of the bent levers 73 and 74 is assigned a monitoring device 88 and 89, activated by the bent levers 73 and 74 when no staple fiber sliver 11 is within clamping range of said bent levers 73 and 74. If, on the other hand, a staple fiber sliver is inserted in its guide (see guide 19), the bent lever is pivoted (see bent lever 74), and its corresponding monitoring device (see monitoring device 89) is activated.

The activation or non-activation of the monitoring device 88 and 89 produces a corresponding signal which is transmitted to a control device 90. The control device takes into account only the signal of that monitoring device 88 or 89 in this case, for which a guide 13 or 19 is in the readiness position.

As seen in FIG. 10, a control device 90 is connected, for control purposes, with a control device 87, or, is alternately, integrated into control device 87. The control device 90 is connected to a sliver starting device 91 which is made and functions in a known manner (see e.g., German Patent publication No. DE-0S 2.911.744)

The sliver starting device 91 has an arm 92, which is pressed against the arm of the bent lever 73 or 74 and subjected to the force of spring 75 or 76 when the staple fiber sliver 11 is inserted into guide 13 or 19, and lifts away from the monitoring device 89. At the same time, the other arm of the bent lever 73 or 74 is lifted from the extension 71 or 72 of guide 13 or 19 so that channel 12 or 18 of guide 13 or 19 is freed.

When the staple fiber sliver 11 is introduced into guide 13 or 19, the sliver starting device 91, if necessary, can also execute a movement relative to arm 92.

FIG. 10 shows the sliver starting device 91, with arm 92, shortly after the insertion of staple fiber sliver 11 into guide 19. The thickness of the staple fiber sliver 11 causes the bent lever 74 to remain pivoted under the influence of the slightly pulled-back arm 92, even after its release, to such an extent, that, although the monitoring element 89 is not activated again, the inserted staple fiber sliver 11 is clamped by the bent lever 74.

If the guide 13 is in the readiness position 13' indicated by broken lines in FIG. 10, this is signalled through control device 87 to control device 90. The latter registers through monitoring device 88 the absence of the staple fiber sliver 11 at guide 13. The control device 90 initiates the insertion of a new staple fiber sliver 11 into the empty guide 13. Furthermore, it causes, in a manner not shown here, the sliver starting device 91, with arm 92, to be brought into position 91' or 92', and to take up a staple fiber sliver out of a can (not shown), which was made ready in the meantime, and to insert the sliver into guide 13, which is in readiness position 13'. Pivoting of the bent lever 73 by arm 92 against channel 12 frees, at the same time, channel 12 for the introduction of staple fiber sliver 11 in the manner described above. The sliver starting device 91 is then withdrawn, whereby the started staple fiber sliver 11 is retained in channel 12 by the configuration of the latter. When arm 92 is at a sufficient distance from bent lever 73, the latter is pressed against the staple fiber sliver 11 and further secures its position.

Figure 12:
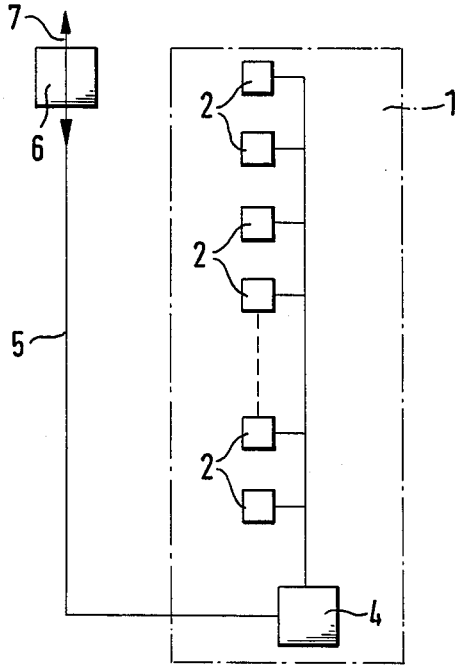
FIG. 12 is a schematic illustration of a spinning machine with a plurality of spinning stations, and of a service unit, capable of travelling alongside the machine.

FIG. 12 shows a spinning machine 1 which could, for instance, be an open-end spinning machine, and which has a plurality of spinning stations 2. Each of these spinning stations 2 is provided with a feeding device, each with a feeding roller 14 (not seen in FIG. 12), and is connected through a collecting main 3 to a control device 4, which is, in turn, connected through a signal circuit 5 to a service unit 6, capable of travelling alongside the spinning machine 1 (see double arrow 7).

Each spinning station 2 is equipped with guides 13 and 19, which have been omitted in FIG. 12, for the sake of clarity. The guides 13 and 19 are located in front of the feeding roller 14, and can be brought, alternately, into a feeding position and into a readiness position.

Monitoring elements are also provided, which are omitted from FIG. 12 for the sake of clarity. The arrangement is, however, similar to that of the embodiment in FIG. 10, so that the absence of a staple fiber sliver is detected at any spinning station 2. The individual spinning stations 2 are checked separately, one after the other, by means of a clock oscillator (not shown) of control device 4. When the absence of a staple fiber sliver 11 is detected, this information is transmitted by control device 4 to the service unit 6 which carries with it, a sliver starting device (not shown). The drive of the service unit 6 begins to move unit 6, if the latter is not in the process of carrying out a service operation, and if it is, stores the command, bringing it to the spinning station 2 concerned where it starts a new staple fiber sliver 11 at the guide 13 or 19, which has become empty in the meantime.

Instead of using a control device 4 made in form of a demand or call device for service unit 6, it is also possible to provide for a signal light 8 at each spinning station 2, lighting up when the staple fiber sliver 11 is absent. This will be explained in further detail with reference to FIG. 11.

Figure 13:
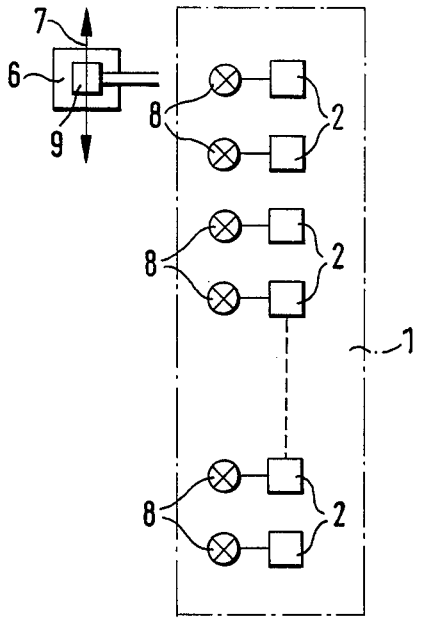
FIG. 13 is a schematic illustration of an alternate design of the spinning apparatus shown in FIG. 12.

The service unit 6, capable of travelling alongside spinning machine 1, is equipped with a sensor 9 (See FIG. 13) which stops the service unit 6 when a lit signal lamp 8 has been reached, and the service unit then starts up a new fiber sliver 11 in the described manner.

In open-end spinning devices, especially, it is advantageous when an interruption of the spun yarn is accepted knowingly when a staple fiber sliver 11 is used up. This is true because it is difficult to avoid irregularities in the spun yarn if a new staple fiber sliver is pieced without interrupting the spinning process.

To avoid thick or thin spots in connection with a sliver replacement it is best to wait for a yarn breakage to occur as a result of the old staple fiber sliver having been used up. A new staple fiber sliver 11 is then started at this spinning station. Fibers which have been combed out of this new staple fiber sliver 11 by the opening cylinder 16 are conveyed to a spinning device, e.g. a spinning rotor, but are then immediately removed from it once more before the spinning process has started again. Only when it is certain that the beginning of the new staple fiber sliver has been removed in this manner is the end of the previously broken yarn, which has been prepared for piecing in the usual way, fed back to the spinning device and is combined with the new fibers of the staple fiber sliver fed by piecing in a known manner.

It has been proven advantageous to combine the introduction of the sliver beginning of the newly started staple fiber sliver immediately with a cleaning of the open-end spinning device. For this purpose, fiber feeding is first switched on for only a brief span of time, the spinning device is cleaned in a known manner with the fibers fed in being again removed from the spinning device, and only then is the conventional piecing operation carried out as sliver feeding, and with it fiber feeding is again switched on.

Figure 11:
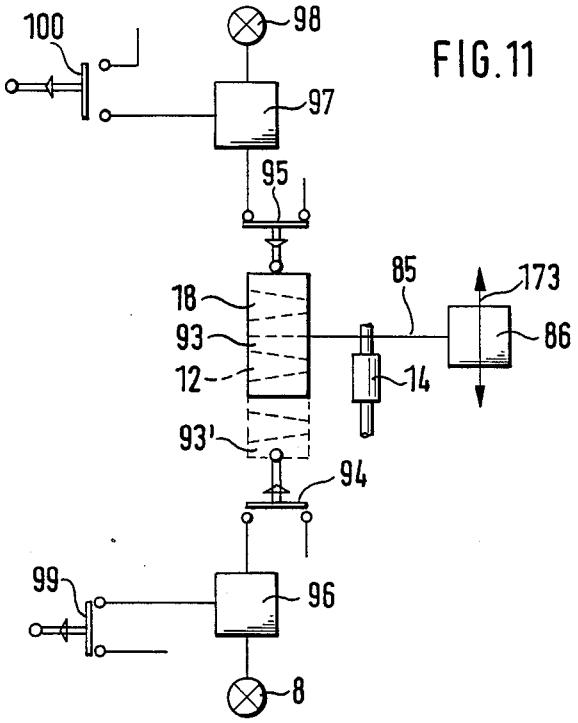
FIG. 11 illustrates, schematically, part of an alternative control device.

FIG. 11 shows as an example a guiding element 93 into which guides 13 and 19 are integrated and which is connected via drive 85 element to a drive 86. The guiding element 93 can be moved by drive 86 either in direction of the double arrow 173 only, or into the direction of the double arrow 65 (see FIG. 10) so that the guides 13 or 19 may be as close as possible to the feeding roller 14.

At either end of the stroke path of guiding element 93 is an limit switch 94 or 95 which is connected to a control device 96 or 97 to which the signal lamp 8 or an additional signal lamp 98 is furthermore connected. A second limit switch 99 or 100 is also connected to each control device 96 or 97.

Signal lamp 8 and also signal lamp 98 (which is not shown in FIG. 13 for the sake of clarity) indicate the absence of a staple fiber sliver 11 and cause the passing service unit 6 to stop. Signal lamp 8 is switched on by the movement of the guiding element 93 away from the position indicated by a solid line and into a position 93' indicated by a broken line in FIG. 11, in which the limit switch 94 is activated. This causes current to reach the control device 96, thus causing signal lamp 8 to light up.

When the service unit 6 has inserted a new staple fiber sliver into channel 12, in the manner described earlier, an element of the service unit 6 activates limit switch 99, in a manner which is not shown. This causes a switching command signal to be transmitted to control device 96 which interrupts the current supply to signal lamp 8, which is then shut off.

When staple fiber sliver 11, being fed to a feeding roller 14 through channel 18 has been used up or is interrupted, the action of pushing back the guiding element 93 across limit switch 95, and control device 97, causes signal lamp 98 to light up in a similar manner. This causes the service unit 6, travelling alongside spinning machine 1, to stop and to start up a new staple fiber sliver 11 at channel 18, and then to shut off the signal lamp 98 by means of limit switch 100 by interrupting the current flow to said signal lamp 98 in a manner not shown.

If no service unit 6 is provided, or if the latter is used for purposes other than the piecing of a new staple fiber sliver 11, limit switch 99 or 100 can be activated manually after introduction of a new staple fiber sliver.

Figure 14:
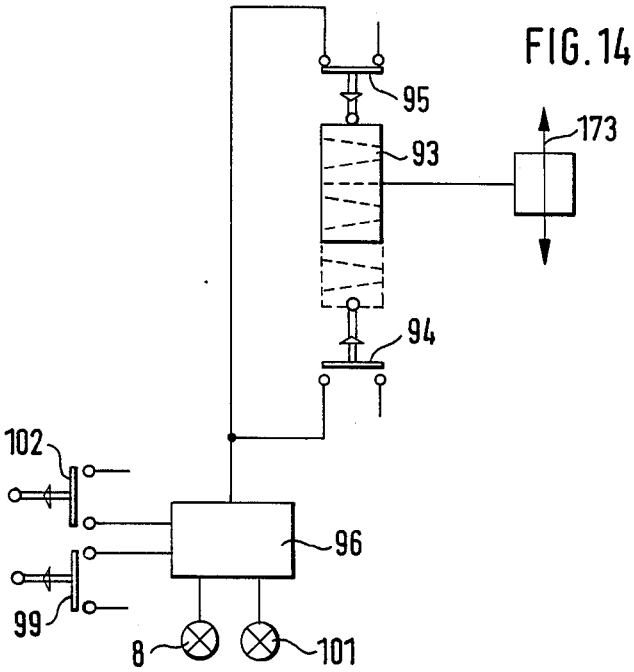
FIG. 14 is a schematic illustration of another embodiment of a control device for the invention.

In an alternate embodiment of the invention, limit switches 94 and 95 can also be connected to one and the same control device 96 and, through it to one single signal lamp 8 which is shut off after the sliver start-up is cmpleted by limit switch 99 (see FIG. 14).

An additional signal lamp 101 can also be provided, which is made to light up by limit switch 94 or 95. This signal lamp serves to inform the operator that a can has been emptied and must be replaced by a full can. When the empty can has been replaced by a full can the operator activates an additional limit switch 102, causing signal lamp 101 to shut off. If an automatic device is provided to replace empty cans by full cans, this limit switch 102 is activated by this device.

Figure 15:
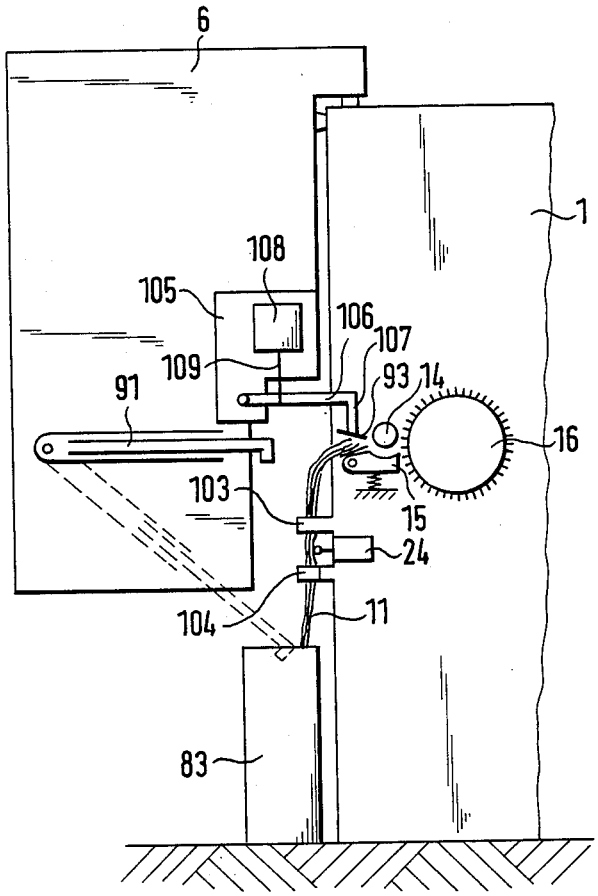
FIG. 15 is a lateral view of a portion of an open-end spinning apparatus, built according to the invention.

A further variation of the device according to invention is shown in FIG. 15. The staple fiber sliver 11 is taken from a can 83 and is held by two guides 103 and 104 within the scanning range of a monitoring device 24. Guides 103 and 104 are here open at the side in the shown, preferred configuration, so as to allow for lateral threading of the staple fiber sliver 11 by appropriate movement of the sliver starting device 91, and are at a sufficient distance before the feeding device so that the replacement of the ending staple fiber sliver by a newly presented staple fiber sliver can also be carried out without interruption of the work process, should this be desired.

FIG. 15 shows a service unit 6 equipped with a drive 105, which is capable of being moved in relation to service unit 6, parallel to its direction of travel and is part of a switch-over device for the two guides 13 and 19 or of a common guide unit 93. This drive 105 is equipped with a pivoted arm 106 with a catch projection 107 which can be engaged into a corresponding recess (not shown) in guide unit 93 and which is subject to the movement of the drive 105. A pivot drive 108, e.g. in form of a solenoid, the anchor of which is flexibly connected through a coupling 109 to the pivoted arm 106, is also installed on the drive 105.

When the service unit 6 stops at a spinning station 2 to start a new staple fiber sliver 11, and to introduce it into the empty channel of the guide unit 93, the pivoted arm 106 is first lowered by means of the pivot drive 108. By means of a scanning means (not shown) a control device (also not shown) ascertains whether the catch projection 107 has or has not entered the recess (not shown) of the guide unit 93. The pivoted arm 106 is, at this time, located in one of its two end positions. If the control device ascertains that the catch projection 107 merely lies on the surface of the correspondingly sized guide unit 93, the pivoted 106 is brought into its other end position by means of pivot drive 105, where the catch projection 107 enters into the recess (not shown) in guide unit 93.

The entry of the catch projection 107 into the recess in guide unit 93, indicates to the above-mentioned control device that the drive 105 is in its starting position for switch-over of the guide unit 93. The drive 105, now carries out the offset movement to feed the new fiber sliver, whereby channel 12 or 18, in which the reserve sliver is located, is brought into the feeding position. If desired, the pivoted arm 106, in combination with the offset movement explained above, can also carry out a retraction and advance movement, or a back-pivot and forward pivot movement, as was described earlier in reference to FIGS. 1 to 4, or 5 and 6.

An automatic start-up of the sliver is not only possible with spinning machines such as open-end and ring spinning machines, but also with other textile machines in which staple fiber sliver are treated or processed. As mentioned earlier, such a sliver can in such cases be provided in cans or can be fed from bobbins, etc.

Figure 16:
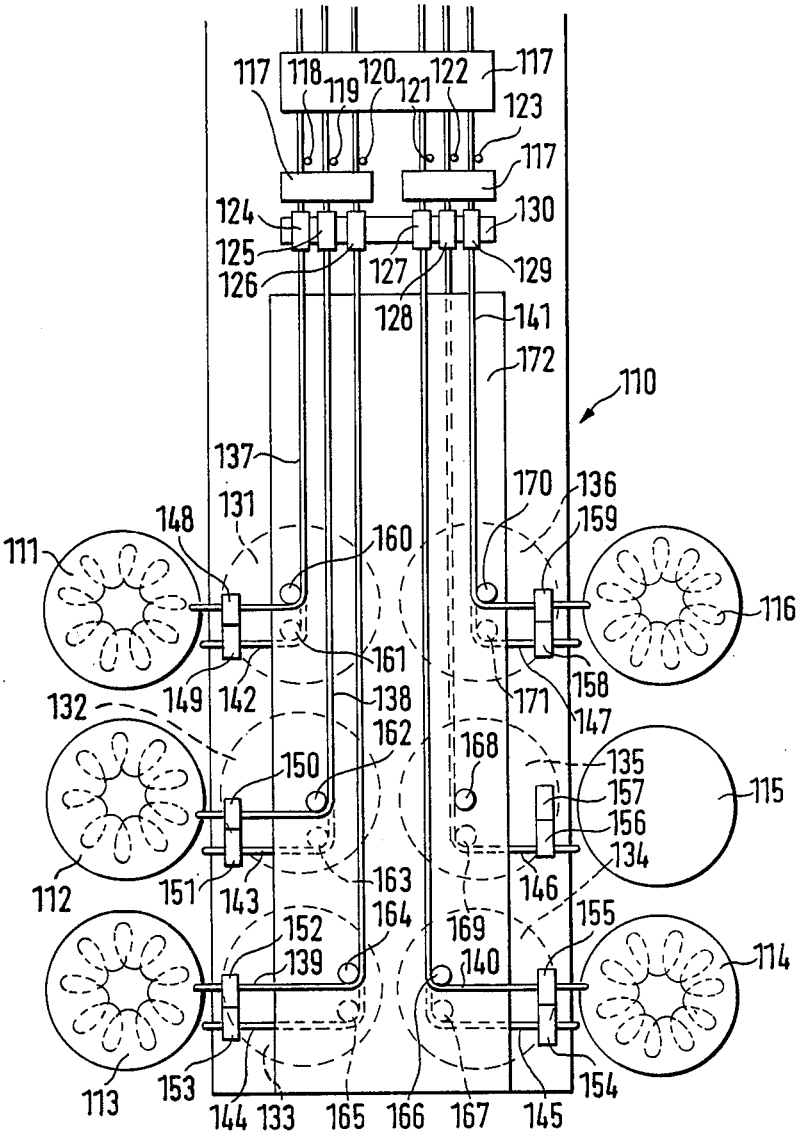
FIG. 16 is a top view of a drawing frame, according to the invention.

According to FIG. 16, the textile machine shown, comprises a drawing frame 110 with several sliver intakes and a common feeding device (drawing roller unit 117). FIG. 16 shows only a portion of this drawing frame 110. The six fiber slivers to be drawn are taken from six cans 111, 112, 113, 114, 115, and 116 and are conveyed to the drawing frame 117. Of these slivers, only the first to the fourth as well as the sixth sliver 137, 138, 139, 140 and 141 are visible, as the fifth sliVer has been used up so that its can 115 is empty. The fiber slivers are monitored in the drawing frame 117 or upstream of it by means of six sliver monitors 118, 119, 120, 121, 122 and 123.

The guide units 124, 125, 126, 127, 128 and 129, capable of being adjusted perpendicularly to the plane of the drawing, in the embodiment shown, by means of a drive 130, are located upstream of drawing frame 117. Each guide unit 124 to 129 is provided with two channels 12 and 18, as in the above-described guide unit 93, serving as guides of a first fiber sliver which is in the feeding position and to receive and guide a second fiber sliver which is in its readiness position. Channels 12 and 18 can be brought, alternately, into their feeding or readiness positions.

In addition to the above-mentioned cans 111 to 116, a second set of cans 131, 132, 133, 134, 135 and 136 for fiber slivers 142, 143, 144, 145, 146 and 147 is provided.

Feeding rollers 148 to 159 are provided for the feeding of the fiber slivers. Only one feeding roller of each pair of feeding rollers 148/149, 150/151, 152/153, 154/155, 156/156 and 158/159 is driven, with the position of the guide unit 124, 125, 126, 127, 128 or 129 determining which of the two feeding rollers is driven or stopped, in each pair. The fiber slivers 137 to 147 are deflected between the feeding rollers 148 to 159 and the guide units 124 to 129 by means of deflection pulleys 160 to 171, whereby one deflection pulley of each pair of deflection pulleys 160/161, 162/163, 164/165, 166/167, 168/169 and 170/171 is located above a separating plate 172, and one deflection pulley is located below it. This separating plate holds all the fiber slivers 137 to 141 of cans 111 to 116 separated from the fiber slivers 142 to 147 of cans 131 to 136 between the feeding rollers 148 to 159 and the guide units 124 to 129.

According to FIG. 16, the guide units 124 to 127 and 129 are in their end positions in which each of them feeds a fiber sliver 137 to 141, running above the separating plate 172, to the drawing frame 117. The guide unit 128, on the other hand, is in its other end position, in which it feeds fiber sliver 146, which runs below the separating plate 172 to the drawing frame 117.

Into each of the guide units 124 to 127 and 129 a second fiber sliver 142 to 145 and 147 has already been introduced and is now in readiness position. The new fiber sliver must be introduced for the first time into the guide element 128, however, after the replacement of can 115 by a new can. This can be done manually or by means of a sliver starting device (not shown).

The change-over of the guide units for the feeding of a new sliver when the previously fed sliver has been used up is effected in the manner described earlier.

The empty cans can be replaced during the production operation. When adjoining, outside cans are not placed too close to each other, this presents no difficulties for cans 131 to 136, especially since they can also be pushed to the side to a certain extent for can replacement.

If desired, sliver monitors (not shown) can be installed near the feeding rollers 148 to 159 instead of the shown sliver monitors 118 to 123, or in addition to them. Since these are triggered earlier than the shown sliver monitors 118 to 123, it is also possible to control sliver replacement by means of these sliver monitors((-not shown) in such a way that sliver end and sliver start overlap and prevent yarn breakage.

What is claimed is:

1. A process for the automatic starting of a staple fiber sliver on a textile machine equipped with a feeding device, a first guide being in a feeding position relative to the feeding device and feeding the staple sliver to the feeding device, a second guide maintaining a second fiber sliver in a readiness position relative to the feeding device, means for monitoring the presence of a staple fiber in the first guide and a device for emitting a signal responsive to the monitoring means for starting feeding of the second fiber sliver to the feeding device, the process comprising the following steps:

(a) inserting a first sliver into the first guide;
(b) positioning the first guide at the feeding position relative to the feeding device;
(c) feeding the first sliver into the feeding device;
(d) positioning the second guide at its readiness position relative to the feeding device;
(e) inserting a second sliver into the second guide;
(f) moving the first guide from the feeding position to the readiness position when the feeding of the first staple fiber sliver to the feeding device is interrupted;
(g) moving the second guide to the feeding position as the first guide is moving away from the feeding position upon interruption of the feeding of the first staple fiber sliver to the feeding device;
(h) monitoring the first guide at its readiness position for the presence of a staple fiber sliver;
(i) emitting a signal from the signal emitting device for as long as a staple fiber sliver is absent from the first guide at its readiness position; and
(j) stopping emission of the signal from the signal emitting device in conjunction with the insertion of a new staple fiber sliver into the first guide at its readiness position.

2. A process as in claim 1, further comprising the step of:

causing a new staple fiber sliver to be inserted into the empty first guide positioned at the readiness position responsive to the signal being emitted by the signal emitting device.

3. A process for the automatic starting of a staple fiber sliver on an open end spinning device equipped with a feeding device, a first guide being in a feeding position relative to the feeding device and feeding the staple sliver to the feeding device, a second guide maintaining second fiber sliver in a readiness position relative to the feeding device, means for monitoring the presence of a staple fiber in the first guide and a device for emitting a signal responsive to the monitoring means for starting feeding of the second fiber sliver to the feeding device, the process comprising the following steps:

(a) inserting a first staple fiber sliver into the first guide;
(b) positioning the first guide at the feeding position relative to the feeding device;
(c) feeding the first sliver into the feeding device;
(d) positioning the second guide at its readiness position relative to the feeding device;
(e) inserting a second staple fiber sliver into the second guide;
(f) moving the first guide from the feeding position to the readiness position when the feeding of the first staple fiber sliver to the feeding device is interrupted;

(g) moving the second guide to the feeding position simultaneously as the first guide is moving away from the feeding position upon interruption of the feeding of the first staple fiber sliver to the feeding device;

(h) feeding the beginning of the second staple fiber sliver to the open-end spinning device;

(i) taking the beginning of the second staple fiber sliver out of the open end spinning device;

(j) effecting piecing;

(k) monitoring the first guide at its readiness position for the presence of a staple fiber sliver;

(l) emitting a signal from the signal emitting device for as long as a staple fiber sliver is absent from the first guide at its readiness position; and (m) stopping emission of the signal from the signal emitting device in conjunction with the insertion of a new staple fiber sliver into the first guide at its readiness position.

4. A process as in claim 3, wherein:

the step of feeding the beginning of the second staple fiber sliver to the open end spinning device comprises briefly feeding fibers into the openend spinning device when the second staple fiber sliver is initially positioned at the feeding position;

the step of taking the beginning of the second staple fiber sliver out of the open end spinning device comprises cleaning the open-end spinning device after the brief feeding of fiber; and the process further comprising the step of resuming feeding the second staple fiber sliver to the open end spinning device after piecing is effected.

5. A process for the automatic starting of a staple fiber sliver on an open end spinning device equipped with a feeding device, a first guide being in a feeding position relative to the feeding device and feeding the staple sliver to the feeding device, a second guide maintaining a second fiber sliver in a readiness position relative to the feeding device, means for monitoring the presence of a staple fiber in the first guide and a device for emitting a signal responsive to the monitoring means for starting feeding of the second fiber sliver to the feeding device, the process comprising the following steps:

(a) inserting a first staple fiber sliver into the first guide;

(b) positioning the first guide at the feeding position relative to the feeding device;

(c) feeding the first sliver into the feeding device;

(d) positioning the second guide at its readiness position relative to the feeding device;

(e) inserting a second staple fiber sliver into the second guide;

(f) moving the first guide from the feeding position to the readiness position when the feeding of the first staple fiber sliver to the feeding device is interrupted;

(g) moving the second guide to the feeding position simultaneously as the first guide is moving away from the feeding position upon interruption of the feeding of the first staple fiber sliver to the feeding device;

(h) feeding the beginning of the second staple fiber sliver to the open-end spinning device;

(i) taking the beginning of the second staple fiber sliver out of the open end spinning device; and (j) effecting piecing.

6. A process as in claim 5, wherein:

the step of feeding the beginning of the second staple fiber sliver to the open end spinning device comprises briefly feeding fibers into the open-end spinning device when the second staple fiber sliver is initially positioned at the feeding position;

the step of taking the beginning of the second staple fiber sliver out of the open end spinning device comprises cleaning the open-end spinning device; and the process further comprising the step of resuming feeding the second staple fiber sliver to the open end spinning device after piecing is effect.

7. An apparatus for the automatic starting of a staple fiber sliver on a textile machine equipped with at least one feeding device, at least one feeding device having a first guide for a first staple fiber sliver being in a feeding position and a second guide for a second staple fiber sliver being in a readiness position, with means for guiding the second staple fiber sliver to the at least one feeding device when the first staple fiber sliver is being used up, the textile machine further being equipped with feeding monitoring means for monitoring the first staple fiber sliver being fed to the feeding device in order to cause the second staple fiber sliver to be fed to the feeding device when feeding of the first staple fiber sliver to the feeding device is interrupted, the apparatus comprising:

(a) drive means for moving said guides either into the feeding position or into the readiness position, (b) means for connecting the two guides to each other so that when one guide is moved from the feeding position into the readiness position, the other guide is moved from the readiness position into the feeding position;

(c) readiness position means for monitoring the guide positioned at its readiness position for the presence of a staple fiber sliver; and (d) means for emitting a signal to indicate the absence of a staple fiber sliver in the guide positioned at the readiness position, said signal emitting means being in communication with said readiness position monitoring means and emitting a signal responsive to said readiness position monitoring means.

8. An apparatus as in claim 7 further comprising:

a plurality of adjoining sliver feeding stations, each said feeding station having a feeding device and each said feeding device having two said guides;

a service unit capable of travelling alongside said sliver feeding stations;

means for calling said service unit to a particular feeding position, said calling means being connected to the feeding position monitoring means so that said calling means can be actuated by the feeding position monitoring means.

9. An apparatus as in claim 8, wherein:

said service unit has means for simultaneously moving one of said guides from a feeding position to a readiness position and the other of said guides from a readiness position to a feeding position.

10. An apparatus as in claim 8, further comprising:

a control device, and wherein said service unit has a drive connected to said calling means via said control device.

11. An apparatus as in claim 7, wherein:

the textile machine is a drawing frame having a plurality of sliver feeders; and the feeding device is assigned to several sliver feeders and has a first guide and a second guide capable of being alternately brought into a feeding position and a readiness position as required.

12. A process for the automatic starting of a staple fiber sliver on a textile machine equipped with a drawing frame with several sliver feeding positions, with at least one feeding device, at least one feeding device having a first guide being in a feeding position relative to the feeding device and feeding the staple fiber sliver to the feeding device, the at least one feeding device further having a second guide maintaining a second fiber sliver in a readiness position relative to the feeding device, means for monitoring the presence of a staple fiber in the first guide, and a device for emitting a signal responsive to the monitoring means for starting feeding of the second fiber sliver to at least one feeding device, this being assigned jointly to several sliver feeding positions, the process comprising the following steps:

(a) inserting a first sliver into a first guide;
(b) inserting a second sliver into the second guide;
(c) positioning the first guide at a feeding position relative to the feeding device;
(d) feeding the first sliver into the feeding device;
(e) positioning the second guide at a readiness position relative to the feeding device;
(f) monitoring the first guide for the presence of the first staple fiber sliver;
(g) moving the first guide from its feeding position into its readiness position when the feeding of the first staple fiber sliver to the feeding device is interrupted;
(h) moving the second guide into the feeding position as the first guide is moving away from the feeding position upon interruption of the feeding of the first staple fiber sliver to the feeding device; and
(i) feeding the second sliver into the feeding device.

13. An apparatus for the automatic starting of a staple fiber sliver on a textile machine equipped with at least one feeding device, at least one feeding device having a first guide for a first staple fiber sliver being in a feeding position and a second guide for a second staple fiber sliver being in a readiness position, with means for guiding the second staple fiber sliver to the at least one feeding device when the first staple fiber sliver is being used up, the textile machine further being equipped with feeding monitoring means for monitoring the first staple fiber sliver being fed to the feeding device in order to cause the second staple fiber sliver to be fed to the feeding device when feeding of the first staple fiber sliver to the feeding device is interrupted, the apparatus comprising:

(a) said textile machine being a drawing frame having a plurality of sliver feeders;
(b) the feeding device being assigned to several sliver feeders each having a first guide and a second guide capable of being alternately brought into a feeding position and a readiness position;
(c) drive means for moving said guides either into the feeding position or into the readiness position,
(d) means for connecting the two guides to each other so that when one guide is moved from the feeding position into the readiness position, the other guide is moved from the readiness position into the feeding position;
(e) readiness position means for monitoring the guide positioned at its readiness position for the presence of a staple fiber sliver; and
(f) means for emitting a signal to indicate the absence of a staple fiber sliver in the guide positioned at the readiness position, said signal emitting means being in communication with said readiness position monitoring means and emitting a signal responsive to said readiness position monitoring means.

* * * * *

Notice of Adverse Decisions in Interference

In Interference No. 102,580, involving Patent No. 4,838,018, Werner G. Hoeber, PROCESS AND DEVICE TO START A NEW STAPLE FIBER SLIVER AUTOMATICALLY, final decision adverse to the patentee was rendered July 31, 1991, as to claims 5 and 12.

*(Official Gazette Oct. 22, 1991)*